United States Patent [19]

Osterhout

[11] Patent Number: 4,738,044

[45] Date of Patent: Apr. 19, 1988

[54] LIGHT BEAM TARGET DESIGNATOR

[75] Inventor: Ralph F. Osterhout, San Francisco, Calif.

[73] Assignee: Tekna, Belmont, Calif.

[21] Appl. No.: 876,030

[22] Filed: Jun. 18, 1986

[51] Int. Cl.[4] ..... F41G 1/36

[52] U.S. Cl. ..... 42/103; 219/121 LV; 219/121 LS; 362/110; 356/252; 350/252

[58] Field of Search ..... 42/103, 100, 101; 33/233, 235, 241, 245, 246; 362/110, 113, 114; 356/153, 252, 247, 72; 244/3.13; 350/252, 6.3; 219/121 LS, 121 LR, 121 LV, 121 LU

[56] References Cited

U.S. PATENT DOCUMENTS

| | | | |
|---|---|---|---|
| 2,653,386 | 9/1953 | Winton | 33/56 |
| 3,522,992 | 8/1970 | Jaffe | 356/5 |
| 3,710,798 | 1/1973 | Bredemeier | 219/121 LS |
| 3,752,587 | 8/1973 | Myers et al. | 356/153 |
| 3,803,399 | 4/1974 | Smith et al. | 240/61 |
| 3,918,813 | 11/1975 | Rossiter | 356/153 |
| 4,125,755 | 11/1978 | Plamquist | 219/121 LS |
| 4,161,076 | 7/1979 | Snyder | 42/103 |
| 4,212,109 | 7/1980 | Snyder | 33/241 |
| 4,260,254 | 4/1981 | Braun | 356/154 |
| 4,266,873 | 5/1981 | Hacskaylo et al. | 356/251 |
| 4,291,478 | 9/1981 | Lough | 42/103 |
| 4,313,272 | 2/1982 | Matthews | 42/103 |
| 4,313,273 | 2/1982 | Matthews et al. | 42/103 |
| 4,317,304 | 3/1982 | Bass | 42/102 |
| 4,349,838 | 9/1982 | Daniel | 358/125 |
| 4,385,834 | 5/1983 | Maxwell, Jr. | 356/153 |
| 4,386,848 | 6/1983 | Clendenin et al. | 244/3.13 |
| 4,408,602 | 10/1983 | Nakajima | 219/121 LS |

OTHER PUBLICATIONS

I.B.M. Technical Disclosure Bulletin, vol. 23, No. 6, Nov. 1980, "Laser Beam Steering System", G. G. Via.

*Primary Examiner*—Deborah L. Kyle
*Assistant Examiner*—Michael J. Carone
*Attorney, Agent, or Firm*—Townsend & Townsend

[57] ABSTRACT

A light beam target designator includes a first beam generator and a second beam generator. The beams are aligned so that they may be selectively directed to a common beam deflecting mechanism which allows for deflection of the beams to compensate for windage, distance to target, and the like. Typically, the first beam generator is a visible light laser and the second beam generator is an infrared laser. In this way, a single target designator is provided which is useful both at night and during the day.

10 Claims, 2 Drawing Sheets

LIGHT BEAM TARGET DESIGNATOR

BACKGROUND OF THE INVENTION

1. Field of the Invention

The present invention relates generally to device capable of projecting a light beam which assists in the aiming of a firearm. More particularly, the invention relates to such a light beam target designator having a pair of light sources and capable of selectively projecting either light sources through a common focusing and deflecting assembly.

For some time, light beams have been used to assist in the aiming of firearms. Commercially available devices commonly employ lasers as a light source and are mounted on the firearm so that the laser beam is precisely aligned with the bore or shaft of the weapon. Frequently, the laser is mounted within an enclosure, and the enclosure is adjustably attached to the firearm so that the alignment of the laser beam relative to the bore or shaft of the firearm may be adjusted to compensate for factors such as distance to the target, windage, and the like.

Usually, such laser target designators employ a visible light beam for use during daylight hours. The use of visible light beams at night, however, is disadvantageous since it is often possible to trace a visible light beam back to its source. This is undesirable during military operations since it would allow the opposing forces to quickly identify the point of origin of the fire. For this reason, laser target designators employing infrared beams have been developed. Such infrared beams are visible to those using infrared image intensifers, but invisible to all others. Such infrared target disignators may thus be used with relative safety at night.

Heretofore, to obtain both night and day operation capability, it has been necessary for troops and others to have available both visible light and infrared target disignators. The use of such separate systems, however, is undesirable for several reasons. First, the amount of equipment which must be carried by the troops is doubled. Second, the target designator must be changed at both dawn and nightfall when troops are on alert. Finally, in some situations the troops will be rapidly moving between light and dark conditions where the changing of the designator is effectively impossible.

For these reasons, it would be desirable to provide a single target designator device capable of selectively projecting either visible light or infrared light target designating beams. Moreover, it would be desirable if such a device could employ a common focusing and deflecting means for both beams so that when the beam sources change, the new designating beam is directed along exactly the same path as the old designating beam.

2. Description of the Relevant Art

U.S. Pat. Nos. 4,291,478; 4,161,076; and 4,212,109 each disclose laser target designators employing a single light source. U.S. Pat. Nos. 3,918,813; 4,260,254; and 4,266,873 each disclose laser alignment systems which allow a user to view the laser beam through the laser focusing system. U.S. Pat. No. 4,385,834 discloses a wedge system for aligning a beam deflecting prism. Also of relevance to the present invention are U.S. Pat. Nos. 2,653,386; 3,752,587; 3,803,399; 4,313,272; 4,313,273; 4,317,304; and 4,349,838.

SUMMARY OF THE INVENTION

According to the present invention, a beam aiming device includes a first beam generator and a second beam generator mounted in an enclosure. A first mechanism is provided for aligning the first beam and the second beam along a common beam path, and a second mechanism is provided for adjustably deflecting a beam projected along the common beam path. Such deflection allows precise adjustment of the direction of the beam emanating from the enclosure regardless of which generator is its source. By providing a first beam generator operating in the visible light region and a second beam generator operaing in the infrared light region, visible and infrared designating beams may be projected in precisely the same direction. The user is thus able to switch between the visible light and infrared beams as the external light conditions warrant without having to change target designators and without loss of alignment accuracy.

In the preferred embodiment, the first beam generator is a visible light laser and the second beam generator is an infrared laser. A mirror and beam splitter assembly is provided to align the two beams along a common path, while the beam deflecting mechanism comprises a conventional Galilean telescope having a focusing and a collimating lens.

According to another aspect of the present invention, the lens assembly is mounted within the enclosure on a gimbal mounting assembly. A mechanism is provided for deflecting the lens assembly in one plane to adjust the azimuth of the beam and in the orthogonal plane to adjust the elevation of the beam. Conveniently, such adjustment mechanism may comprise a pair of tapered wedges mounted to translate axially on threaded shafts which are disposed parallel to the direction of focus of the lens assembly. The wedges, as they are moved forward and back on the shafts, act against rods which transmit force transversely to the lens assembly.

DESCRIPTION OF THE PREFERRED EMBODIMENT

Figure 1:
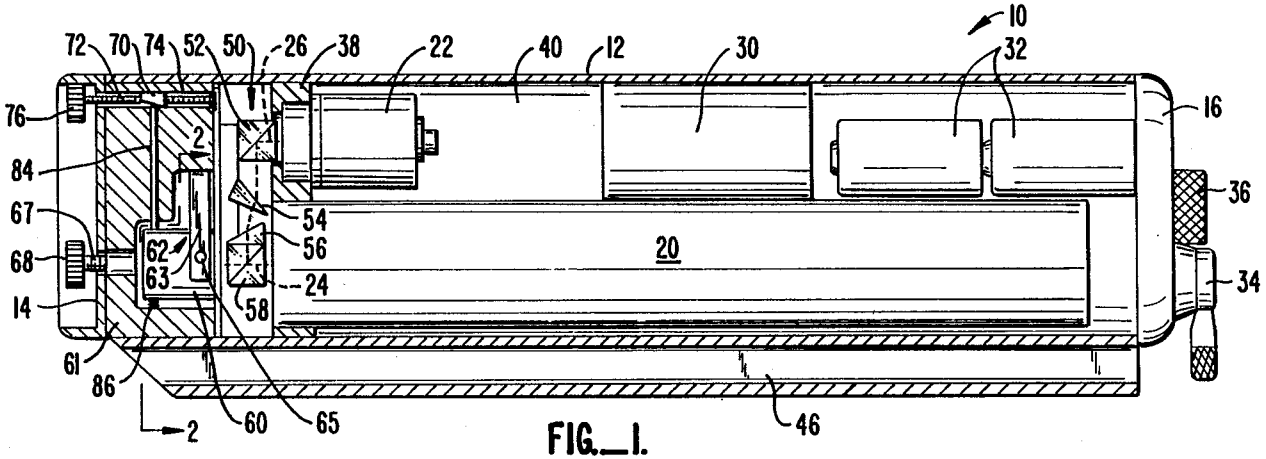
FIG. 1 is a side elevational view of a laser target designator constructed according to the principles of the present invention shown in section.

Referring to FIG. 1, a light beam target designator 10 constructed in accordance with the principles of the present invention includes an elongate enclosure 12 having a front piece 14 and rear cap 16.

A first beam generator 20 and a second beam generator 22 are mounted within the enclosure. While both beam generators 20 and 22 will usually be lasers capable of producing a coherent light beam, other focused beam generators may also find use. As illustrated, the first beam generator 20 is a visible light laser, typically an argon or helium-neon laser capable of projecting a coherent beam along line 24. The second beam generator 22 is an infrared laser, typically a solid state laser, capable of projecting an infrared beam along line 26. The beams 24 and 26 are shown to be substantially parallel in projecting forward toward the front end piece 14 of the enclosure 12. While this is a particularly convenient arrangement, other arrangements are possible, including orienting the second beam generator 22 so that the beam emanating therefrom is focused directly at the path of beam 24 from the first beam generator. As will be seen, such an arrangement would eliminate the need to use mirrors for directing the infrared beam toward the visible light.

A power supply 30 operates from batteries 32 to supply the necessary current for operating both beam generators 20 and 22. A switch 34 is provided on the rear cap 16 to allow the user to select between operation of beam generator 20 and beam generator 22. As will be seen, the nature of the light beam projected from the designator 10 depends on which beam generator 20 or 22 is operating. Rear cap 16 is further provided with a thumb screw 36 which allows the user to move the rear cap 16 to replace batteries 32.

Both beam generators 20 and 22 are mounted on a partition wall 38 which separates a rear compartment 40 from a forward compartment 42 of the enclosure 12. In this way, the forward compartment 42, which contains all of the optical components of the designator 10, is sealed from the rear compartment 40 which may be opened. Thus, dust and other contamination which may enter the rear compartment 40 is prevented from entering the forward compartment and contaminating the optical equipment.

A tube 46 is provided along one side of the enclosure 12. The tube 46 is useful for mounting the target designator 10 on a firearm, such as a rifle. Such mounting systems are well known and need not be described further.

In order to align the infrared beam path 26 with the visible light beam path 24, an optical deflecting assembly 50 is provided. The assembly 50 includes a mirrored prism 52 which receives the beam 26 and reflects it transversely toward visible light beam 24, and a pair of prisms 54 and 56 which provide for proper alignment of the infrared beam into a beam splitter 58. The beam splitter 58 reflects the infrared beam forward along precisely the same path which is taken by visible light beam 24. As the beam splitter 58 is a partially reflecting surface, the visible light beam 24 is able to penetrate through the beam splitter without deviation from the common path with the infrared beam.

The light beam 24 or 26 (depending on which laser is on) then enters a lens assembly 60 which is capable of enlarging the beam to a desired width. The lens assembly 60 is mounted within mounting block 61 on a gimbal assembly. The gimbal assembly 62 includes a clevis 63 which is pivotally attached to block 61 by pin 64. The lens assembly 60, in turn, is pivotally mounted within the clevis 63 by pin 65. Thus, the lens assembly 60 may be directionally adjusted about two axes 90° apart to correct both the elevation and the azimuth of the beam by exerting a force in the desired direction on the assembly.

Figure 3:
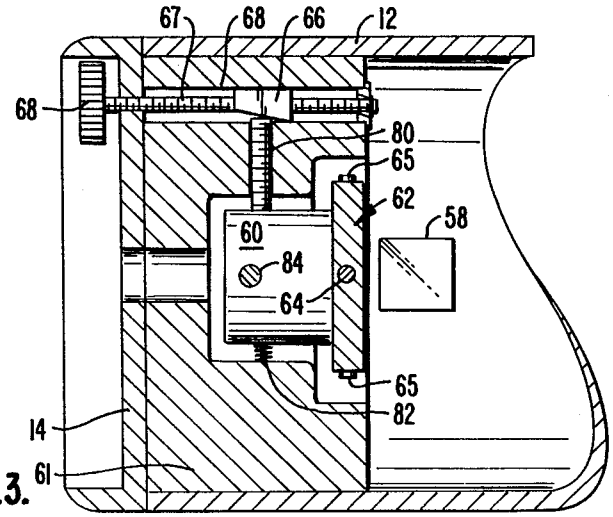
FIG. 3 is a detailed sectional view taken along line 3—3 of FIG. 2.
Figure 2:
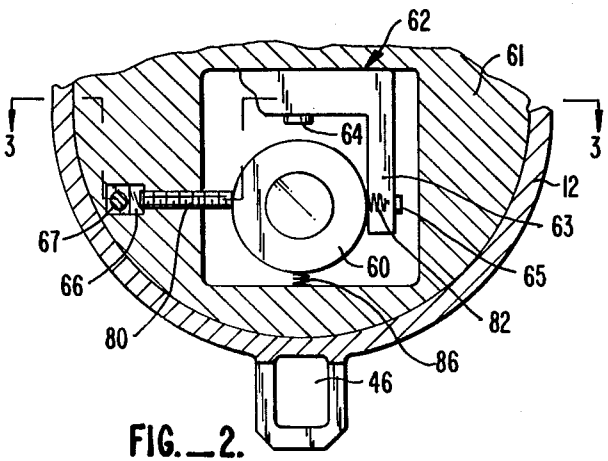
FIG. 2 is a detailed sectional view taken along line 2—2 of FIG. 1.

Referring now also to FIGS. 2 and 3, a first tapered wedge 66 is mounted on a threaded shaft 67 which is received through the front piece 14 and passes through a bore 68 formed in mounting block 61. The wedge 66 receives shaft 67 through an axial threaded hole so that rotation of shaft 67 by turning head 68 causes the wedge 66 to translate forward or backward, depending on the direction of rotation. Similarly, a second wedge 70 (FIG. 1) is mounted on a threaded shaft 72. The shaft 77 passes through a bore 74 formed in the mounting block 61 at a location 90° removed from the first threaded shaft 67. Rotation of threaded shaft 72 by head 76 causes forward and backward translation of the wedge 70.

First wedge 66 engages a rod 80 which engages the upper surface of lens assembly 60. In this way, rotation of knob 68 which causes rearward translation of the wedge (toward the rear cap 16) an upward deflection of the lens assembly 60. Forward translation of the wedge 66 (toward front piece 14), conversely, causes a downward deflection of the lens assembly 60. In this way the elevation of the beam emanating from the lens assembly 60 may be adjusted.

In a like manner, rearward deflection of wedge 70 (caused by rotating knob 76) relieves force against a rod 84, allowing a spring 86 to deflect the lens assembly upward. Forward translation of the wedge 70, conversely, applies a force on the lens assembly 60 and causes the assembly to deflect downward. In this way, the azimuth of the beam emanating from the lens assembly 60 may be adjusted.

Figure 4A:
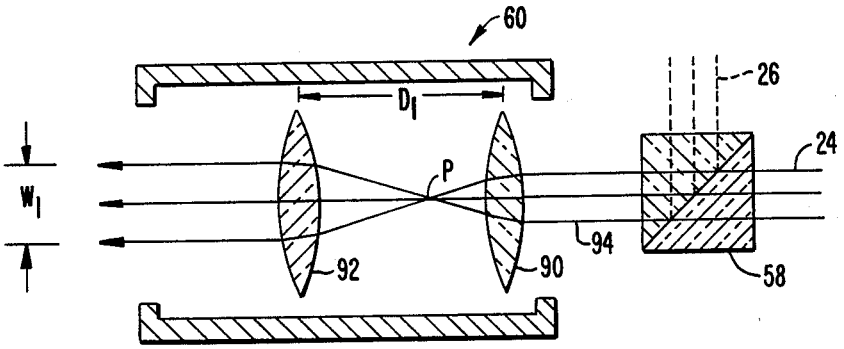
FIGS. 4A and 4B are schematic views illustrating the operation of the lens assembly.
Figure 4B:
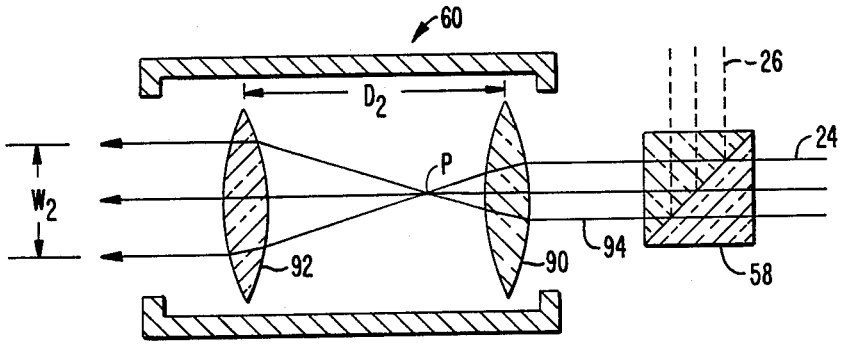

Referring now also to FIGS. 4A and 4B, the lens assembly 60 typically includes a fixed focusing emanating from the beam splitter 58 (which may originate from either beams 24 or 26) pass through the focusing lens 90 and are focused to a point P within the lens assembly 60. The beams then diverge and pass through the collimating lens 92 which returns the beams to a parallel state having a width depending on the distance between lenses 90 and 92. as illustrated in FIG. 4A, a distance $D_1$ between the lenses results in a beam width $W_1$. By moving the lenses further apart to a distance $D_2$ as illustrated in FIG. 4B, a greater beam width $W_2$ is achieved as illustrated in FIG. 4B.

In operation, the light beam designator is mounted on a firearm, typically a pistol or rifle. The direction of the beam may then be set by aiming the beam and firing. The adjust knobs 68 and 76 may then be used to correct the elevation and azimuth of the beam so that it coincides with the actual firing direction. Subsequent adjustments may also be made for distance and windage. It is an advantage of the device of the present invention that once alignment is made for either the visible or infrared beams, no further adjustment is requred for the other beam.

Although the foregoing invention has been described in some detail by way of illustration and example for purposes of clarity of understanding, it will be obvious that certain changes and modifications may be practiced within the scope of the appended claims.

What is claimed is:

1. A beam aiming device, said device comprising:

an enclosure;

a first beam generator mounted within the enclosure, said first beam generator capable of directing a beam along a first preselected path;

a second beam generator mounted within the enclosure, the second beam generator capable of direction a beam along a second preselected path;

means for manually selectively operating either the first beam generator or the second beam generator in a continuous manner, whereby the device has two modes of operation;

means for aligning the first beam and the second beam along a common path; and an assembly comprising a collimating lens and a focusing lens, said assembly being pivotally mounted along the common path for adjustably deflecting the beam which is directed along said common path so that said beam is aimed in a desired direction relative to the enclosure.

2. A beam aiming device as in claim 1, wherein the beam generators are lasers producing light of different wavelengths.

3. A beam aiming device as in claim 2, wherein one of the laser produces light in the visible region and the other produces light in the infrared region.

4. A beam aiming device as in claim 1, wherein the means for aligning the first beam and the second beam includes a mirror assembly located along the first beam path and oriented direct the first beam toward the second beam path and a beam splitter assembly located along the second beam path, which beam splitter receives both the first and second beams and directs said beams to the means for deflecting.

5. A beam aiming device as in claim 4, wherein the mirror assembly includes at least one mirrored surface and at least one prism for directing the first beam to the second beam path.

6. A beam aiming device as in claim 1, wherein the first and second beam paths are parallel but spaced-apart.

7. A beam aiming device, said device comprising:

an enclosure;

a first beam generator mounted within the enclosure, said first beam generator capable of directing a beam along a first preselected path;

a second beam generator mounted within the enclosure, the second beam generator capable of directing a beam along a second preselected path;

means for mounting the enclosure on a firearm;

means for aligning the first beam and the second beam along a common path;

a gimbal assembly mounted within the enclosure;

a lens assembly mounted on the gimbal assembly and lying along the common beam path; and means for adjusting the elevation and the azimuth of the lens assembly, said means comprising a pair of wedges spaced apart by 90° about the lens assembly so that translation of the wedges causes the lens assembly to deflect in either of two orthogonal planes.

8. A beam aiming device as in claim 7, wherein the beam generators are lasers producing light of different wavelengths.

9. A beam aiming device as in claim 8, wherein one of the laser produces light in the visible region and the other produces light in the infrared region.

10. A beam aiming device as in claim 7, wherein the means for aligning the first beam and the second beam includes a mirror assembly located along the first beam path and oriented to direct the first beam toward the second beam path and a beam splitter assembly located along the second beam path, which beam splitter receives both the first and second beams and directs said beams to the means for deflecting.

* * * * *